United States Patent [19]

Schulein

[11] Patent Number: 4,610,044

[45] Date of Patent: Sep. 9, 1986

[54] WIPING CLOTH WITH EDGE REINFORCEMENT

[75] Inventor: Rolf G. Schulein, Singhofen, Fed. Rep. of Germany

[73] Assignee: Leifheit Aktiengesellschaft, Nassau/Lahn, Fed. Rep. of Germany

[21] Appl. No.: 670,859

[22] Filed: Nov. 13, 1984

[30] Foreign Application Priority Data

Nov. 19, 1983 [EP] European Pat. Off. ..... 83111575

[51] Int. Cl.[4] ..... A47L 13/20

[52] U.S. Cl. ..... 15/119 R

[58] Field of Search ..... 15/119 K, 119 A, 231, 15/232

[56] References Cited

U.S. PATENT DOCUMENTS

| | | | |
|---|---|---|---|
| 708,857 | 9/1902 | Bracey | 15/119 R |
| 877,895 | 1/1908 | Lappin | 15/119 R |
| 2,023,021 | 12/1935 | Jenkins | 15/119 R |
| 2,145,536 | 1/1939 | Watson | 15/119 R |
| 2,306,249 | 12/1942 | Cooper | 15/119 R |
| 2,977,619 | 4/1961 | Franzene | 15/119 A |

FOREIGN PATENT DOCUMENTS

| | | | |
|---|---|---|---|
| 512224 | 5/1956 | Italy | 15/119 R |

*Primary Examiner*—Chris K. Moore

*Attorney, Agent, or Firm*—Frishauf & Partners

[57] ABSTRACT

Wiping cloth for a cleaning device with squeezing and-/or wringing facilities (3), whereby on the T-formation hem reinforcement (8) - central reinforcement (9) fixing studs (10) are provided, which are clipped on with an asymmetrical spacing and with their longitudinal axes (2) being disposed on the central pitch line (21) of the retraction device (5).

9 Claims, 5 Drawing Figures

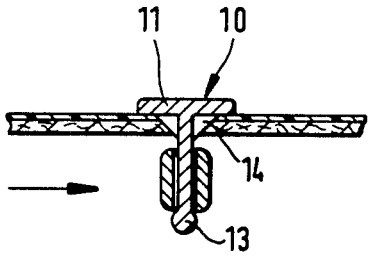
FIG. 3
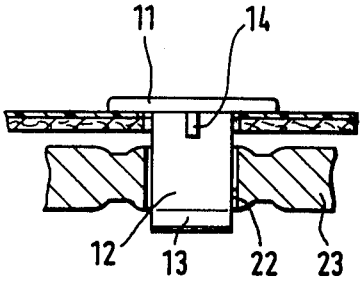
FIG. 4
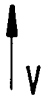
FIG. 5
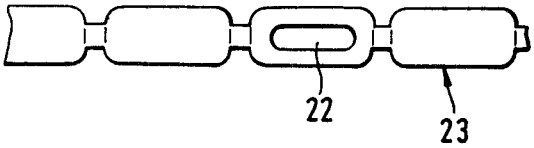

WIPING CLOTH WITH EDGE REINFORCEMENT

The present invention relates to a wiping cloth with hem reinforcement for use with a cleaning device, according to the generic part of claim 1.

Wiping cloths for floor cleaning, which are applied in combination with a scrubbing brush, are already known in various forms. These are made of the most diverse materials, such as cotton, fleece and leather substitutes and are either manually guided or wrapped around some cleaning device, as for example around scrubbers. These kinds of floor cleaning implements do not satisfy the requirements of the housewife for a long time. Particularly, wrapping around the cleaning device the wet wiping cloth is extremely cumbersome.

The object of the present invention is to facilitate this unpleasant work for the housewife, in combination with an appropriately constructed cleaning device. In particular, the attachment of the cloth to the cleaning device, also the subsequent operability and the durability should be improved.

According to this invention, these objects are obtained by the features stated in the characterized part of claim 1.

By these features the wiping cloth attains a higher degree of stiffness, thus a trouble-free working is made possible. The wiping cloth will spread out readily according to the available width. Durability is significantly increased.

Further features of this invention are enumerated in the subclaims. Thus, by the presence of the central reinforcement it is secured that the wiping cloth can be accurately withdrawn into the squeeze- and/or wringing device and—in particular—subsequent to its squeezed condition, it also can be expelled again without unfolding.

By arranging the buttonholes and/or the fixing studs at assymetrical pitch to the central line, an extremely uniform folding can be secured for the squeezing- and-/or wringing process. Further improvement is obtained by the directional course of the fixing studs, whereby each of those is disposed in the direction of the imaginary tangent on the retraction curve.

The mushroom-like shape of the fixing studs, together with the wider head end, enables the direct heat-sealing of the hem reinforcement with the fixing studs and the wiping cloth. An extremely long life expectancy of the wiping cloth is thus obtained. For the hem- and central reinforcement preferably PVC material is used, which is moulded directly to the wiping cloth material in course of the heat-sealing process and thus forms a practically homogeneous bond. In consequence thereof, the wiping cloth is capable of withstanding very strong tensile forces and—on the other hand—has the advantage of safely unfolding, when it is expelled from the squeezing—and/or wringing device.

Figure 1:
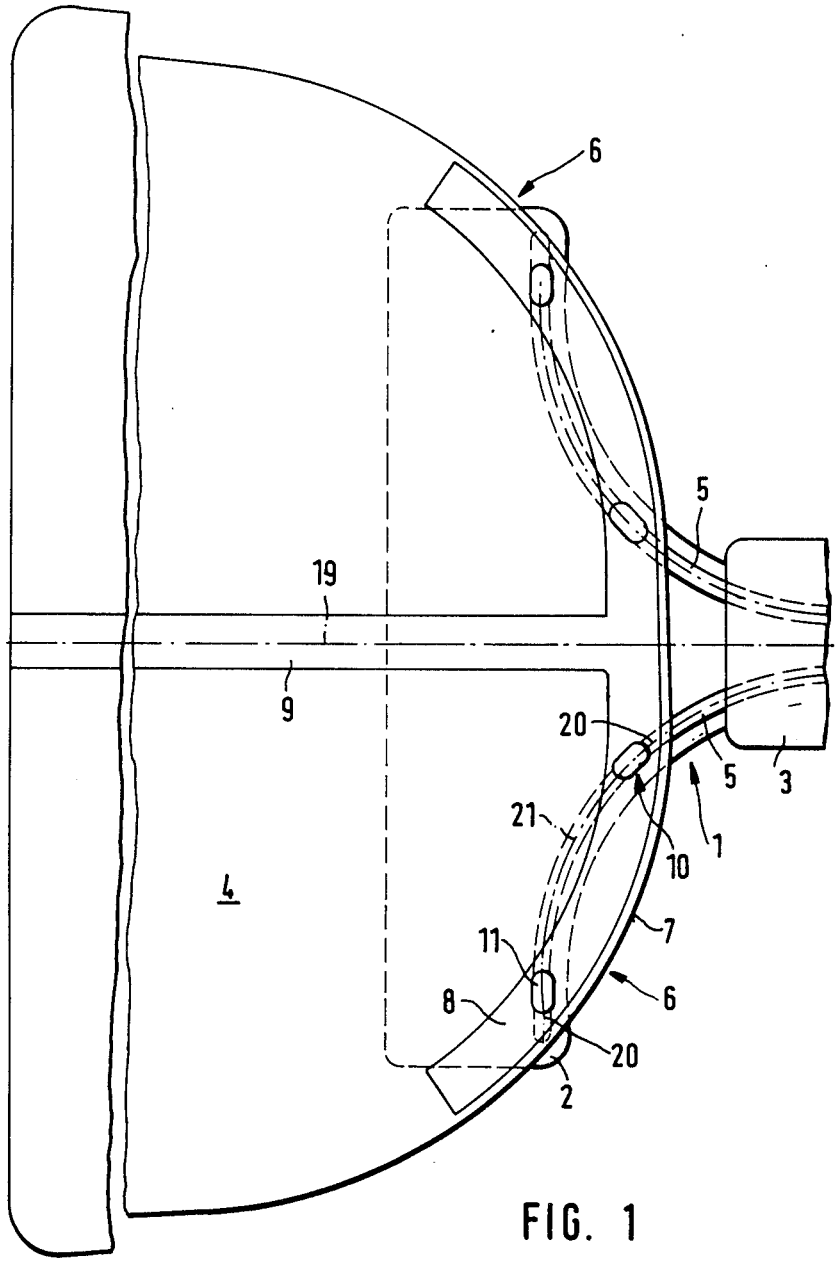
Figure 2:
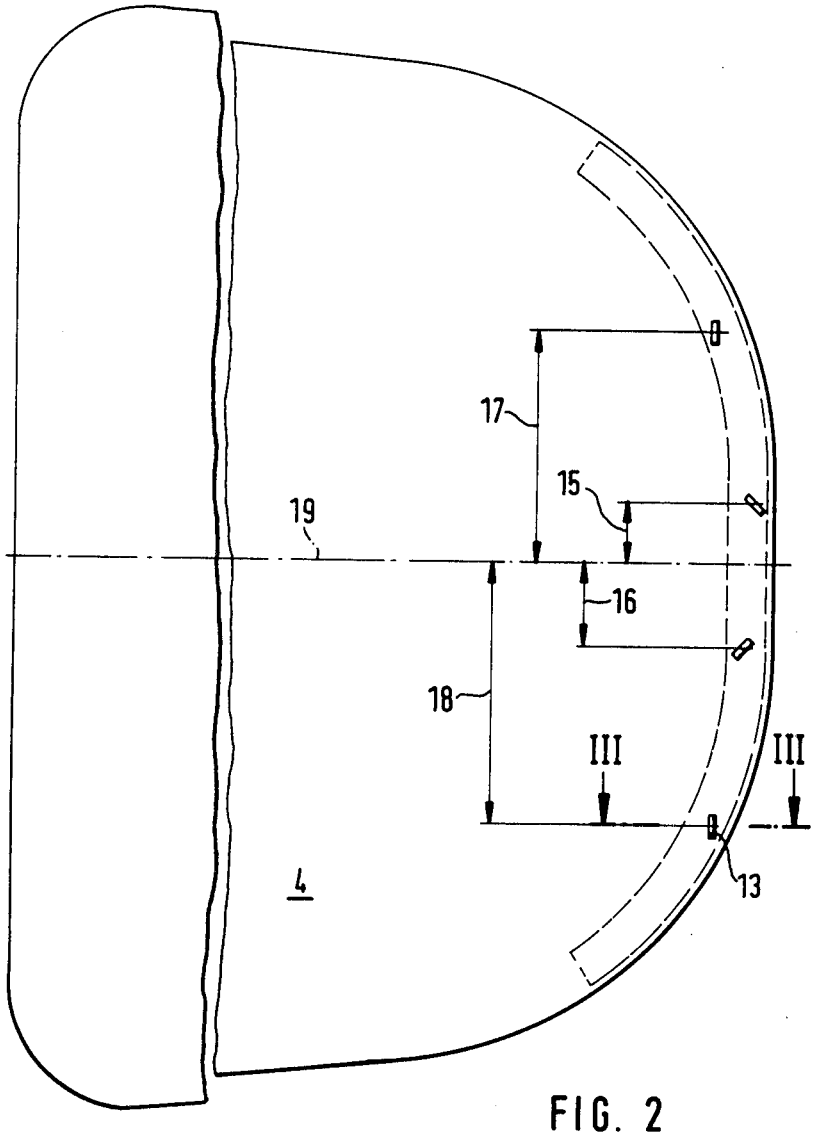

In the following, an exemplified embodiment of this invention will be elucidated in further detail in conjunction with the attached drawings, which show:

FIG. 1—a plan view of the wiping cloth, whereby the wiping head of the cleaning device is also indicated, FIG. 2—a bottom view of the wiping cloth with fixing studs but without wiping head, FIG. 3—section along line III—III in FIG. 2, FIG. 4—a view in the direction IV shown on FIG. 3 and FIG. 5—a plan view according to 'V' in FIG. 4.

A cleaning device 1, having a wiping head 2 and a squeezing device 3, is fitted with a wiping cloth 4. The wiping cloth 4 can be retracted into the squeezing device by retraction device 5. Meanwhile, the retraction device 5 is arranged in an arched shape and extends up to the border region 6 of the wiping head 2.

One side of the wiping cloth 4 is square cut, whilst its front side extends in an arch-shape to the cleaning device. It overlaps slightly the width of the wiping head 2. At the frontal face 7 a hem reinforcement 8 is provided, extending approximately along the width of the wiping head 2. Somewhere at the centre of the wiping cloth 8, a central reinforcement 9 is joined in T-shape to the hem reinforcement 8. Both the hem reinforcement 8 and the central reinforcement 9 are in the form of a PVC strip, whereby the central reinforcement 9 is about one-third smaller than the hem reinforcement 8.

Mushroom-shaped fixing studs 10 are attached to the hem reinforcement 8. These fixing studs 10 consist of a wide head-end 11, a small stem 12 which merges into a retaining bead 13 and two stiffening ribs 14. The fixing studs 10 are arranged along the central line 19 at assymetrical spacings 15, 16, 17, 18. Related to the central line, the difference between these spacings is—at least—as large, as to secure that the fixing studs are lined up without touching one another, when the wiping cloth is in the retracted position. In the extended position of the wiping cloth 4, i.e. in the condition as depicted in FIG. 1, the longitudinal axes 20 of the fixing studs 10 are disposed as tangents to the central pitch-line 21 of the retraction device 5.

The attachment of the fixing studs 10 to the retraction device 5 is carried out by means of oblong holes 22 in flexible rods 23 forming the retraction device 5, the fixing studs 10 being locked therein by the retaining beads 13.

The claims defining the invention are as follows:

I claim:

1. A wiping cloth for use in a cleaning device of the kind which includes a pair of movable flexible rods for supporting the cloth at a working position to clean a floor surface and for retracting the cloth within an associated squeezing device to wring the cloth of a floor cleaning liquid, the rods diverging arcuately from a central axis when supporting the cloth at said working position and flexing when moved to retract the cloth within or expel the cloth from said squeezing device, said wiping cloth comprising:

a cloth having a front edge;

a hem reinforcement fixed along said front edge of said cloth; and a number of fastening elements secured to said hem reinforcement for engaging the flexible rods of the cleaning device;

wherein said fastening elements are arranged asymmetrically relative to said central axis so as to avoid interference with one another when retracted within and expelled from the squeezing device by the flexible rods.

2. Wiping cloth according to claim 1, further comprising a central reinforcement (9) extending substantially along said central axis and which joins said hem reinforcement in a substantially T-shape configuration.

3. Wiping cloth according to claim 1, wherein said fastening elements comprise fixing studs (10) on said hem reinforcement.

4. Wiping cloth according to claim 3, wherein said fixing studs are substantially rectangular.

5. Wiping cloth according to claim 3, wherein said fixing studs have oblongated cross sections.

6. Wiping cloth according to claim 5, wherein the directional disposition of said fixing studs is along an imaginary tangent to the curve of said arcuate flexible rods.

7. Wiping cloth according to claim 1, wherein said hem reinforcement is arch-shaped and extends approximately to side edges of said wiping cloth.

8. Wiping cloth according to claim 1, wherein said fastening elements are mushroom shaped and are provided with a retaining bead (13) adjoining one end of a small stem section (12), and a wide head-end (11) at another end of said small stem section (12).

9. Wiping cloth according to claim 8, wherein said hem reinforcement (8) is heat-sealed to said head-ends (11) and said wiping cloth (4).

* * * * *